US006729342B2

(12) United States Patent
Serhan

(10) Patent No.: US 6,729,342 B2
(45) Date of Patent: May 4, 2004

(54) WALKER WITH RELEASE MECHANISM

(75) Inventor: Michael Serhan, Arcadia, CA (US)

(73) Assignee: Dr. K Healthcare Products, Inc., Monrovia, CA (US)

( * ) Notice: Subject to any disclaimer, the term of this patent is extended or adjusted under 35 U.S.C. 154(b) by 0 days.

(21) Appl. No.: 10/447,527

(22) Filed: May 29, 2003

(65) Prior Publication Data

US 2003/0226584 A1 Dec. 11, 2003

Related U.S. Application Data

(60) Provisional application No. 60/386,342, filed on Jun. 5, 2002.

(51) Int. Cl.[7] ..... A61H 3/00
(52) U.S. Cl. ..... 135/67
(58) Field of Search ..... 135/67, 74; 297/5, 297/6; 482/66, 68; 280/87.021, 87.05, 87.041; 16/421, 430, 110.1

(56) References Cited

U.S. PATENT DOCUMENTS

| | | | | | |
|---|---|---|---|---|---|
| 1,217,709 | A | | 2/1917 | Cobel | |
| 2,842,387 | A | | 7/1958 | Della-Porta | |
| 2,872,252 | A | * | 2/1959 | Konkle | 182/131 |
| 3,688,789 | A | * | 9/1972 | Bunch | 135/67 |
| 3,945,389 | A | * | 3/1976 | Smith | 135/67 |
| 4,448,434 | A | * | 5/1984 | Anderson | 280/40 |
| 4,518,002 | A | | 5/1985 | Battiston, Sr. et al. | |
| 4,640,301 | A | | 2/1987 | Battiston, Sr. et al. | |
| 5,201,333 | A | | 4/1993 | Shalmon et al. | |
| 5,275,187 | A | * | 1/1994 | Davis | 135/67 |
| 5,525,000 | A | | 6/1996 | Belobraydich et al. | |
| 5,529,425 | A | | 6/1996 | Spies et al. | |
| 5,579,793 | A | | 12/1996 | Gajewski et al. | |
| 5,735,025 | A | | 4/1998 | Bailey | |
| 5,862,825 | A | | 1/1999 | Leonard | |
| 5,871,227 | A | | 2/1999 | Huang | |
| 6,032,908 | A | | 3/2000 | Hillstrom et al. | |
| 6,036,221 | A | | 3/2000 | Yang | |
| 6,068,284 | A | | 5/2000 | Kakuda | |
| 6,279,591 | B1 | * | 8/2001 | Obitts | 135/67 |
| 6,318,741 | B1 | * | 11/2001 | Chen | 280/87.041 |

FOREIGN PATENT DOCUMENTS

| | | | |
|---|---|---|---|
| WO | WO 99/17707 | * | 4/1999 |

* cited by examiner

*Primary Examiner*—Janet M. Wilkens
(74) *Attorney, Agent, or Firm*—Fulbright & Jaworski

(57) ABSTRACT

A foldable walker having a paddle shaped lever arranged to interact with locking pins by lateral movement in either direction. In a particular embodiment, the walker has at least two locking positions wherein the walker can hyper-extend, spreading out and locking to a more fully opened configuration, allowing the walker to be pulled closer to the patient making it easier for the patient to lift himself or herself up to a standing position.

13 Claims, 4 Drawing Sheets

WALKER WITH RELEASE MECHANISM

CROSS-REFERENCE TO RELATED APPLICATIONS

This application claims the benefit of Provisional Patent Application No. 60/386,342, filed Jun. 5, 2002.

FIELD OF THE INVENTION

The field of the invention includes a collapsible walker with a release mechanism for use by the aged or infirmed.

BACKGROUND OF THE INVENTION

Many of the aged or infirmed have difficulty walking because they have weakness of the extremities. In order to help these people remain independently mobile, various walking devices have been developed that aid the user in supporting his or her weight. The open walking frame or walker is such a device. Walkers generally consist of four legs attached to form a square frame with at least one side open so that the user can stand within the four legs. The frame has handles so the user can pick up the walker, set it in front, and lean on it to walk forward. In this way, the user can support some of his or her weight with the arms and shoulders. Further, the user can balance his or her weight more easily by shifting to the different sides of the walker.

Walkers have been developed that fold to a small space so that they can be more easily stored when not in use. These types of walkers are comprised of three frames, one in the front and one on each side, with the user stepping into the walker from the rear. When the walker is not being used, the side frames can each be rotated onto the front frame of the walker to reduce storage space. The side frames are locked in the open position by various mechanisms.

There are significant problems for patients with dexterity problems with walkers as presently constructed that have not been adequately addressed by the art. One problem relates to the use of spring-loaded push buttons as locking devices, which require substantial pressure to manipulate, and require the patient to remove his or her hands from the walker handles, thereby removing support when it is most needed. For example, Leonard U.S. Pat. No. 5,862,825 uses an action that requires levers to be pushed downwardly to effect the release of a locking mechanism in which a pivot pin and barrel arrangement is mounted inboard of the side frames. Spies et al U.S. Pat. No. 5,529,425 requires actuating handles to be depressed to release the side frames for folding, and may be operated in only a single direction. Della-Porta U.S. Pat. No. 2,842,387 and Hillstrom et al U.S. Pat. No. 6,032,908 use tubes that rotate within sleeves but do not provide specific locking points. Additionally, the Hillstrom et al cam assembly is only actuated by moving control handles up and down. Battiston, Sr. et al U.S. Pat. No. 4,518,002 requires the depression of plungers to release side frames from the front frame of a walker.

Another problem is that current walker styles are not user friendly. When using a walker to stand, a patient often needs more than one locked position to have more room to maneuver than provided by the typical walker in its locked open position. For example, Battiston, Sr. et al, cited above, allows only one locking position.

SUMMARY OF THE INVENTION

The walker of the present invention overcomes the foregoing deficiencies. It is easy to use by patients with dexterity problems in that it enables a patient to open and close the walker without taking his or her hands off the walker. This is accomplished by a paddle shaped lever arranged to interact with locking pins by lateral movement in either direction.

In one embodiment of the invention, the walker has a single locking position for each of the side frames. In another embodiment, the walker has at least two locking positions for each of the side frames wherein the walker can be hyper-extended, spreading out and locking the walker to a more fully opened configuration, allowing the walker to be pulled closer to the patient making it easier for the patient to lift himself or herself up to a standing position.

In a specific embodiment, a foldable walker is provided comprising front legs defining a front frame, and rear legs and upper members defining side frames with the front legs. The side frames are pivotally connected to the front frame for rotation relative to the front frame. Locking mechanisms are provided at respective pivotal connections, each locking mechanism comprising a housing containing a locking pin pivotally connected to the lever to be movable by the lever. The lever is also pivotally connected, to the housing adjacent an end of the locking pin. The front legs are each formed with at least one aperture to receive the distal end of the locking pin. The aperture is located at a radial angle with respect to the front frame so as to define an open position of the walker and to lock the side frames to the front frame in the open position. The locking pin can have a plate adjacent its distal end and a spring bearing on the plate to spring load the locking pin to its locking position. Paddle shaped levers connect to respective locking mechanisms and are arranged so that lateral movement of the levers in either direction withdraws the locking pin from the respective aperture. This releases the side frames to allow the walker to fold by rotation of the side frames to close with the front frame.

The front legs of the walker can be formed with tubular hinge tubes to which the locking mechanisms are rotatably connected. The connection can be made to rotation rings carried by the hinge tubes via bearing rings fixed to the hinge tubes. One or more rigid support members can bridge and interconnect the hinge tubes.

In a further embodiment of the invention, each locking mechanism can lock to one of two or more positions wider than the open position. In this embodiment, the front legs are each formed with a pair of radially spaced apertures formed to receive the distal end of the locking pin. A first of the apertures is located at a first radial angle with respect to the front frame whereby to define the open position of the walker. The second of the apertures is located at a second radial angle with respect to the front frame, an angle that is greater than the first radial angle to define an extended open position of the walker, which can be referred to as a hyper-extended position.

DETAILED DESCRIPTION OF THE INVENTION

Figure 1:
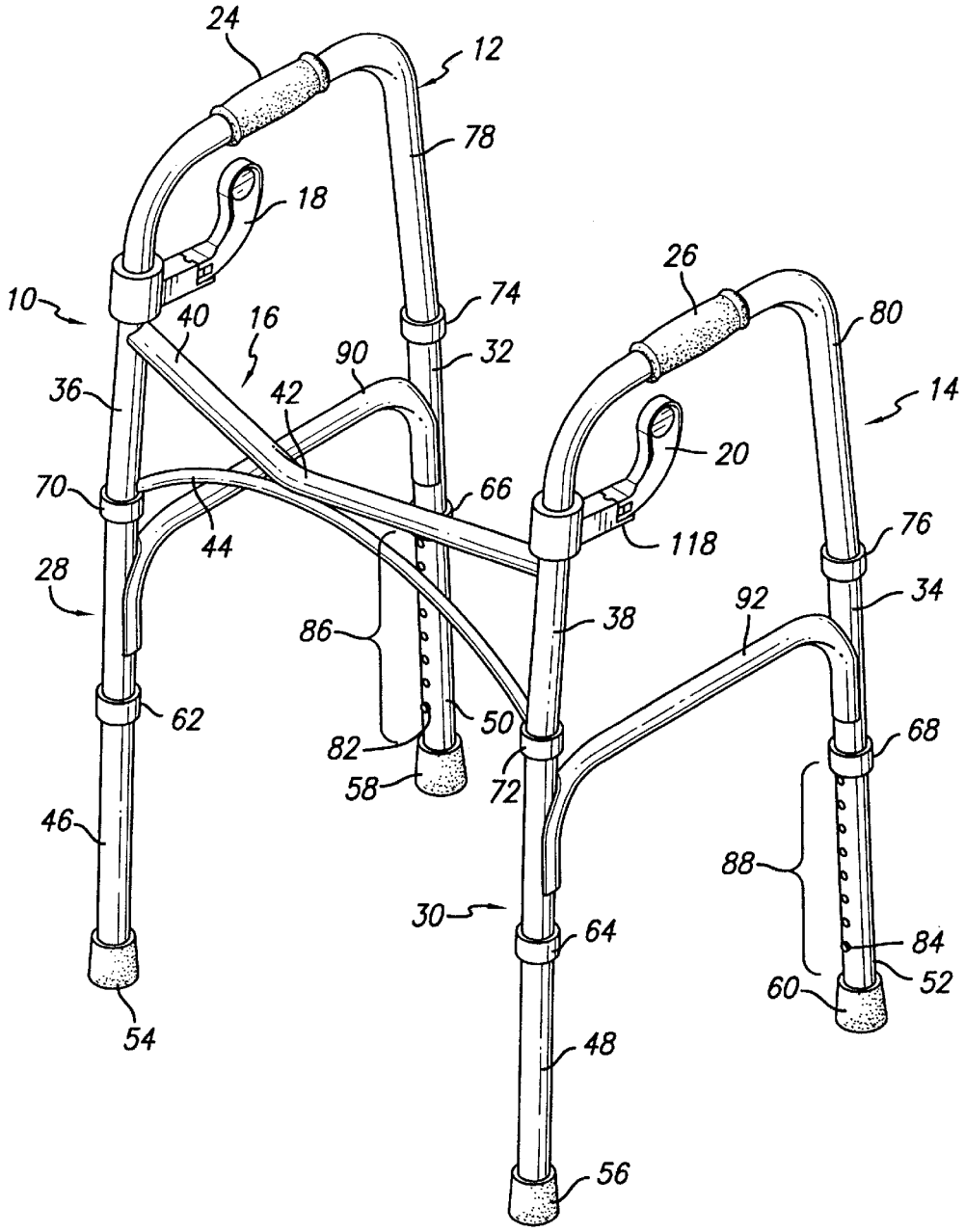
FIG. 1 is a front perspective view of a walker of the present invention according to the first embodiment, open to a single lockable position.
Figure 2:
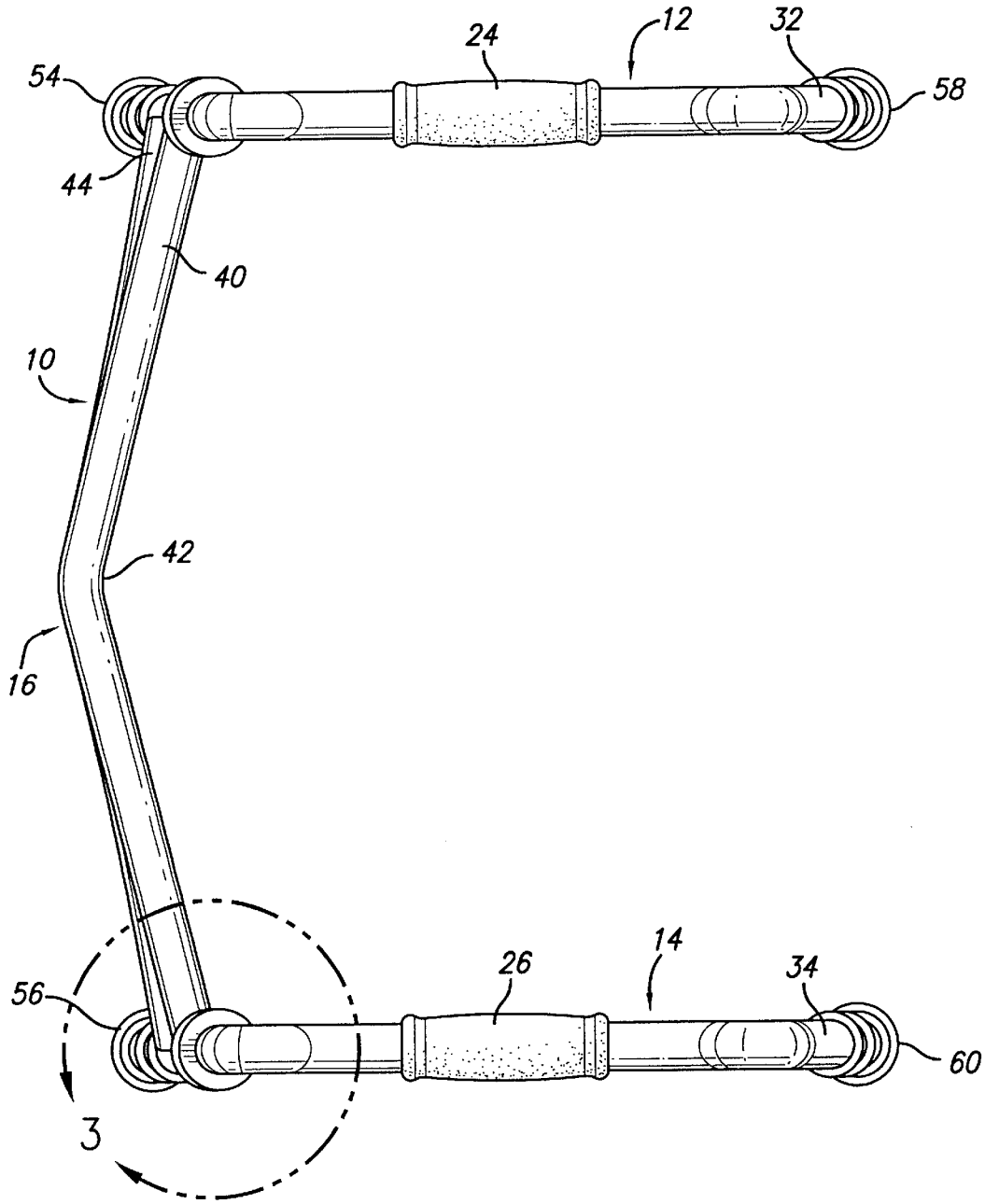
FIG. 2 is a top plan view of the walker of FIG. 1.

Referring to FIGS. 1 and 2, an adjustable folding walker 10 of the present invention is constructed from opposing right and left side frames 12 and 14 connected to and rotatable with respect to a front frame 16. It is designed to be easy to use by patients with dexterity problems in that it enables a patient to open and close the walker without taking his or her hands off the walker. This is accomplished by right and left paddle shaped levers 18 and 20, each arranged to interact with a locking pin 22 (FIGS. 3–5) by lateral movement in either direction to release the locking pin 22. The paddle levers 18 and 20 each have a length and width sufficient to provide the leverage needed to allow an aged or infirm patient to readily flip the levers 18 and 20 in either direction to either fold the walker to a closed position or to open it to a wider configuration. The patient can do this without removing his or her hands from grips 24 and 26 atop each side frame. For example, the paddle levers can each have a hand contact length of at two or more, preferably three or more finger widths, i.e., an inch and a half, preferably at least two and a quarter inches, and a width of at least one, preferably two finger joints, i.e. one inch, preferably two inches. The entire length of the paddle lever is sufficient to provide the needed leverage, for example, three inches, preferably four inches or more.

The front walker frame 16 is defined by a pair of front legs 28 and 30, each side frame 12 and 14 is constructed of a light-weight metal, such as aluminum, and is configured by a hollow cylindrical tube, generally in the shape of an arch, extending to the floor through rear legs 32 and 34. The front legs 28 and 30 include respective hinge tubes 36 and 38 connected to one another by two support members. An upper support member 40 of the front frame 16 is a cylindrical tube, bent downwardly in its middle at 42 in the shape of a "v" and welded to the front leg hinge tubes 36 and 38 just below the top of each hinge tube. A lower support member 44 is a cylindrical tube of smaller diameter than the upper support member 40, curved smoothly to form an arc segment and welded to the front leg hinge tubes 36 and 38 near the bottom of each hinge tube. The hinge tubes 36 and 38 each have an inner radius greater than the outer radius of the median sections of respective front legs 28 and 30 to encompass the respective medium sections to permit the side frames 12 and 14 to rotate about respective front legs.

The user holds onto the grips 24 and 26 when leaning on the walker, using his arms to help support his body weight with the walker. Each grip 24 and 26 is made of soft plastic or other material suitable for holding without slipping, is in the shape of tube with an inner diameter just larger than the side frame tubing so that it fits tightly, and is slightly wider in its center for easier gripping. From each end of the grips 24 and 26, the respective side frame extends out and then curves down toward the floor, forming the respective rear legs 32 and 34. The front and rear legs 28, 30, 32 and 34 are further apart at the bottom than at the top in order to improve stability of the walker 10 as better seen in FIG. 2.

The lower sections of the front legs 28 and 30 and the rear legs 32 and 34 are adjustable feet tubes, respectively 46, 48, 50 and 52, each having a rubber tip, respectively 54, 56, 58 and 60 on its end to prevent slipping. The inner diameter of each foot tube is slightly larger than the outer diameter of the tube of the respective side frame 12 and 14, so that the foot tubes 46, 48, 50 and 52 fit snugly over the medium sections of the respective legs 28, 30, 32 and 34. Mounted on the top of each foot tube section 46, 48, 50 and 52 is a ring cap, respectively 62, 64, 66 and 68 made of polyvinychloride plastic, each having an inner diameter nearly the same as the outer diameter of the respective leg sections at that location so that the ring cap is in positive contact with the leg sections at all times, preventing wobbling and increasing stability of the walker. A similar set of silencer ring 70, 72, 74 and 76, also made of polyvinylchloride, connect, respectively, the hinge tube sections 36 and 38 and rear top sections 78 and 80 of respective legs.

A detent pin is disposed in known fashion at the bottom of each leg 28, 30, 32 and 34, two of which 82 and 84 are shown in the drawing with respect to the rear legs 32 and 34. There are a series of holes running down the sides of the tube foot tubes 46, 48, 50 and 52 equidistant from each other, two of which series 86 and 88 are shown in the drawing, again with respect to the rear legs 32 and 34. Each hole has a diameter just slightly larger than the detent pin so that when a hole is positioned over the detent pin, the pin protrudes therethrough. The height of the walker can be changed by moving the detent pins to a different set of holes, thereby raising or lowering the height of the walker.

Cross braces 90 and 92 in the shape of an inverted "u" connect respective front and rear legs 28–32 and 30–34 and are welded thereto, increasing the stability of the side frames 12 and 14.

It should be understood that accessories which are common in the industry, such as wheels on the front legs can be substituted for the rubber tips 54 and 56 while still practicing the invention. Further, the walker of this invention can be scaled for use by a particular user, or scaled in several sizes, such as "junior," "adult," "tall adult", and "extra wide heavy duty."

Figure 3:
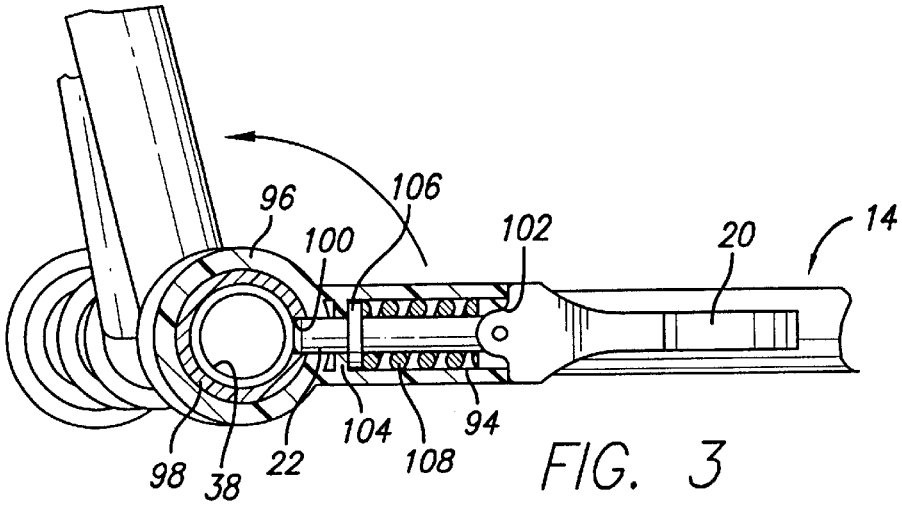
FIG. 3 is an enlarged, partially cross-sectional top view of part of the left side frame and front frame of the walker of FIGS. 1 and 2, taken in the region indicated by line 3 in FIG. 2.
Figure 4:
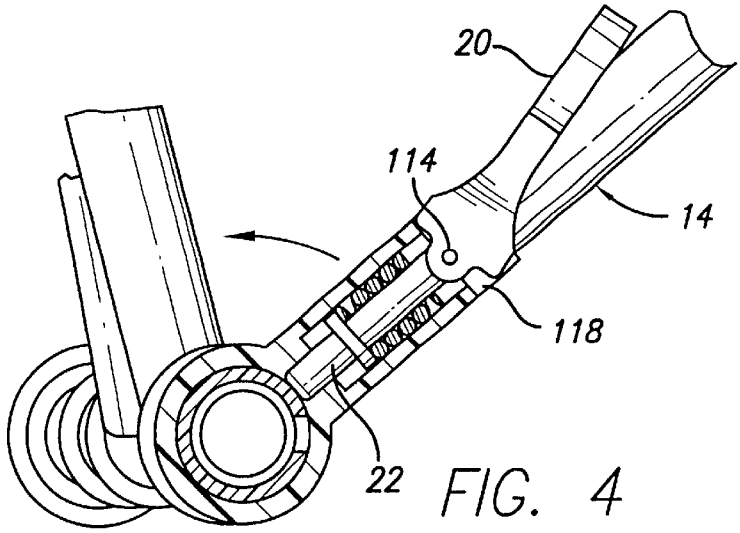
FIG. 4 is a view similar to that of FIG. 3 but showing the left side frame unlocked and partially closed toward the front frame of the walker (the right side of the walker being the mirror image)
Figure 5:
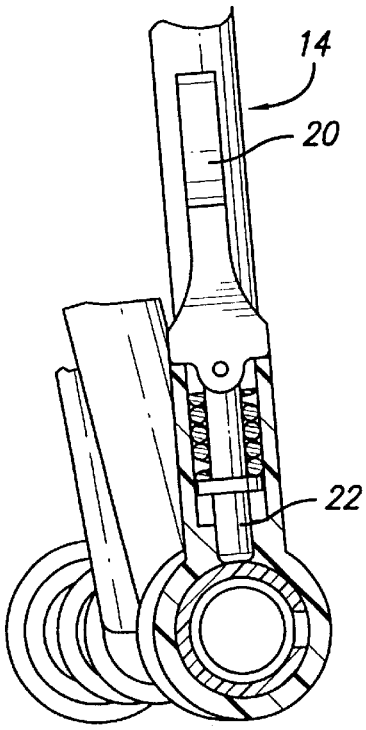
FIG. 5 is a view similar to that of FIG. 3 but showing the left side frame unlocked and closed onto the front frame of the walker.

Referring additionally to FIGS. 3 to 5, partially cross-sectional views of the left paddle lever 20 mechanism are shown. It is understood that the locking mechanism shown is identical to the locking mechanism on the other side of the walker. In FIG. 3, the mechanism is shown with the side frame 14 in the open locked position of FIGS. 1 and 2. In FIG. 4, the mechanism is shown with the side frame 14 partially closed. In FIG. 5, the mechanism is shown with the side frame 14 fully closed. As shown in FIGS. 1 and 3, the paddle lever 20 is connected to the walker frame 30 by a channeled structure 94 riveted to a plastic or composite rotation ring 96 which rotates about a bearing ring 98 carried by the hinge tube 38. The bearing ring 98 is welded to the hinge tube 38 and is formed with an aperture 100 to receive the locking pin 22, locking the walker in an open position.

Figure 8:
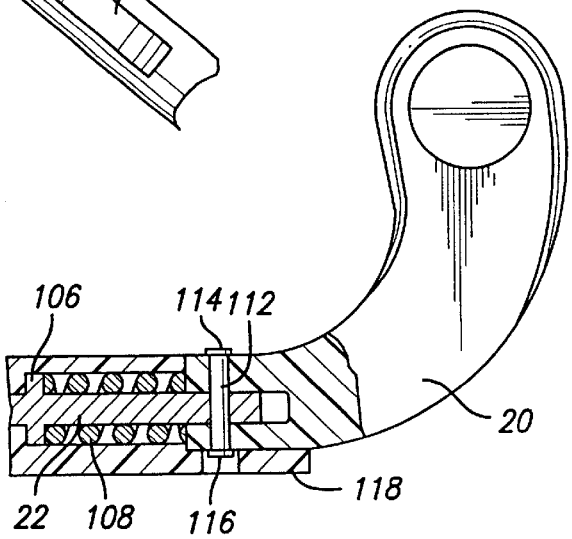
FIG. 8 is a cross-sectional view of the locking pin mechanism.

The channeled structure 94 has an eternally square cross-section and is formed with a cylindrical channel 102 having a distal front wall 104 through which the locking pin 22 extends. The locking pin 22 carries a plate 106 spaced from its distal end which bears on a coil spring 108 that loads the pin 22 to a locking position but which can be further compressed to withdraw the pin 22 from the bearing ring aperture 100. Referring additionally to FIG. 8, the paddle lever 20 has a clevis 110 at its distal end and is pivotally connected to the locking pin 22 by a shackle pin 112 that passes through the clevis 110 and the locking pin 22 and is retained by heads 114 and 116 on opposite sides of the clevis 110. The channeled structure 94 has a bottom platform component 118 extending rearwardly, which is also shown in FIGS. 1 and 4, and which serves as a support for the paddle lever 20 to prevent its downward movement.

As illustrated in FIG. 3, the locking pin 22 is forward-biased by the spring 108 to protrude into the bearing ring opening 100 of the when the walker 10 is in an open position, locking the side frames 12 and 14 in the open position. By moving the paddle levers 20 laterally in either direction, the locking pin 22 is withdrawn from the bearing ring aperture 100, allowing the side frames 12 and 14 to rotate inwardly to the semi-closed position of FIG. 4, continuing to the fully closed position of FIG. 5. Once the locking pin 22 is withdrawn from the bearing ring aperture 100, it rides freely on the outer surface of the bearing ring 98, and the paddle lever 20 can be returned to its neutral position against the expansion bias of the spring 108. To return the walker to its locked open position, the user simply moves the side frames 12 and 14 outwardly until the spring 108 causes the locking pin 22 to engage the bearing ring aperture 100. The extension of the locking pin 22 into bearing ring aperture 100 creates an audible "click" that informs the user that the side frames 12 and 14 are locked open.

The locking-unlocking mechanism of the present invention offers significant advantages over prior mechanisms. It allows a user to release the locking mechanism by lateral movement of the paddle levers, thereby avoiding the need to move one's hands to press spring-loaded push buttons or to press downwardly on levers. Therefore a weak patient can close the walker, or hyper-extend it as will be described below, by simple lateral, sideways movement without the need to press down. Moreover, the lateral movement can be either to the right or left with equally effective results.

Figure 6:
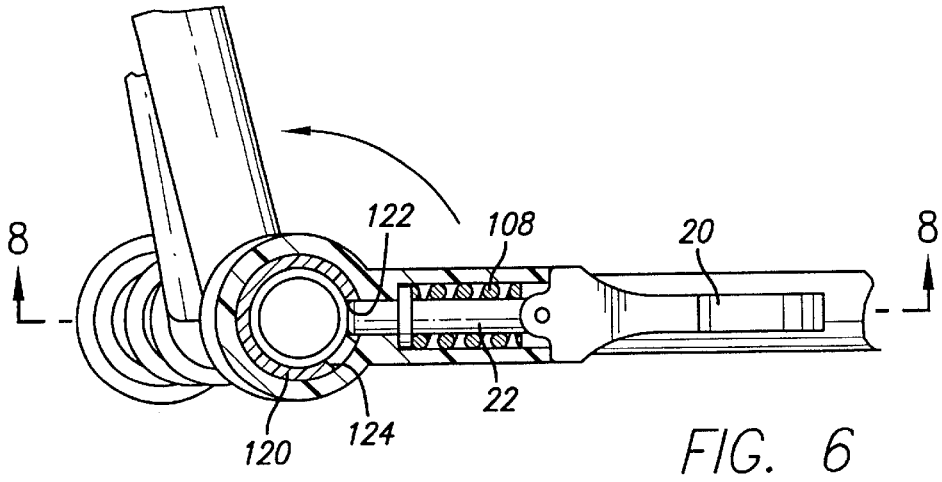
FIG. 6 is a view similar to that of FIG. 3 but of a second embodiment in which the side frames are rotated to a first open lockable position and can be rotated to a hyper-extended lockable position.
Figure 7:
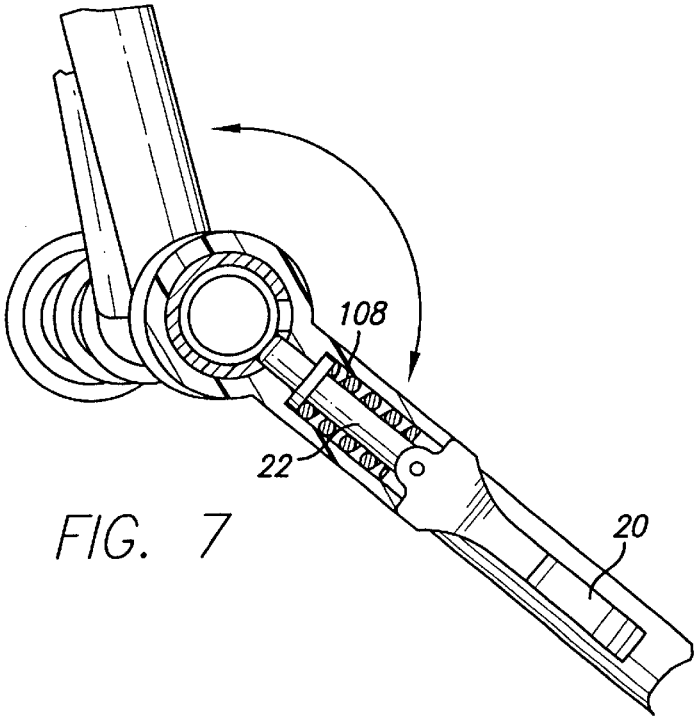
FIG. 7 is a view similar to that of FIG. 6 in which the side frames are rotated to a hyper-extended lockable position.

The walker 10 shown in FIGS. 1–5 cannot be hyper-extended. A mechanism for locking the walker 10 in a hyper-extended position is shown in FIGS. 6 and 7. The mechanism and components are the same as in FIGS. 1–5 except for the presence of an additional bearing ring aperture. Therefore, like element will bear like numerals. FIG. 6 shows the same configuration as in FIG. 3, with the locking pin 22 forward-biased by the spring 108 to protrude into a bearing ring aperture when the walker is in an open position, locking the side frames an open position. However, the bearing ring 120 of the mechanism of FIGS. 6 and 7 has two apertures 122 and 124 spaced about 30 degrees apart, providing a normal locked open position, as shown in FIG. 6, and a hyper-extended locked open position, as shown in FIG. 7. By moving the paddle lever 20 laterally in either direction, the locking pin 22 is withdrawn from the bearing ring aperture 122, allowing the side frames 12 and 14 to rotate outwardly to a the hyper-extended position of FIG. 7 whereupon the locking pin 22 is biased by the spring 108 to protrude into the second bearing ring aperture 124 to lock the walker into its hyper-extended position.

In the locked hyper-extended position, the user can more easily manipulate the walker from a seated position, allowing the walker to be pulled closer to the user making it easier for the user to lift himself or herself up to a standing position. To release the walker from its hyper-extended position, the user simply moves the paddle levers 18 and 20, again in either direction, closing the walker to its normal locked open position of FIG. 6.

The invention thus provides the ability to open and close a walker without the patient having to remove his or her hands from the walker handles. This makes it easier and safer to correctly operate the walker than with conventional walkers. The ability to hyper-extend the walker using the paddle lever releases allows for safer and easier operation of the walker when opening and closing the walker than is obtained with conventional walkers.

What is claimed is:

1. A foldable walker, comprising:

front legs defining a front frame;

rear legs defining side frames pivotally connected to the front frame for rotation relative to the front frame;

locking mechanisms at said pivotal connections, each locking mechanism arranged to lock respective ones of said side frames to the front frame in an open position; and levers connected to respective locking mechanisms and arranged so that lateral movement of the levers releases the side frames to allow the walker to fold by rotation of the side frames to close with the front frame;

said levers being arranged so that lateral movement thereof in either direction releases the side frames.

2. The walker of claim 1 in which at least one of the locking mechanisms is arranged to lock the side frames to the front frame in a position extended from the open position to be wider than the open position.

3. The walker of claim 2 in which said at least one locking mechanism comprises a locking pin movable by the lever, the front legs each formed with a pair of radially spaced apertures formed to receive the distal end of the locking pin, a first of said apertures being located at a first radial angle with respect to the front frame whereby to define the open position of the walker, the second of said apertures being located at a second radial angle with respect to the front frame greater than said first radial angle to define the extended open position of the walker.

4. A foldable walker, comprising:

front legs defining a front frame;

rear leas defining side frames pivotally connected to the front frame for rotation relative to the front frame;

locking mechanisms at said pivotal connections, each locking mechanism arranged to lock respective ones of said side frames to the front frame in an open position; and levers connected to respective locking mechanisms and arranged so that lateral movement of the levers releases the side frames to allow the walker to fold by rotation of the side frames to close with the front frame;

each locking mechanism comprising a locking pin movable by the lever, the front legs each formed with at least one aperture formed to receive the distal end of the locking pin, the aperture being located at a radial angle with respect to the front frame whereby to define the open position of the walker;

the proximal end of the locking pin being pivotally connected to its respective lever whereby lateral movement of the lever withdraws the locking pin from the respective aperture.

5. The walker of claim 4 including a spring loading the locking pin to its locking position.

6. The walker of claim 5 in which the locking pin has a plate adjacent its distal end against which said spring bears.

7. The walker of claim 4 including a housing for the locking pin, said lever being pivotally connected to the housing adjacent the proximal end of the locking pin.

8. The walker of claim 4 in which each locking mechanisms is arranged to lock the side frames to the front frame in a position extended from the open position to be wider than the open position.

9. The walker of claim 8 in which the front legs are each formed with a pair of radially spaced apertures formed to receive the distal end of the locking pin, a first of said apertures being located at a first radial angle with respect to the front frame whereby to define the open position of the walker, the second of said apertures being located at a second radial angle with respect to the front frame greater than said first radial angle to define the extended open position walker.

10. A foldable walker, comprising:

front legs defining a front frame;

rear legs and upper members defining side frames pivotally connected to the front frame for rotation relative to the front frame;

locking mechanisms at said pivotal connections, each locking mechanism comprising a housing containing locking pin pivotally connected to a paddle shape lever to be movable by the lever, the lever being pivotally connected to the housing adjacent the end of the locking pin proximal to the lever, each of the front legs being formed with at least one aperture to receive the distal end of the locking pin, the aperture being located at a radial angle with respect to the front frame whereby to define an open position of the walker and to lock respective a side frame to the front frame in the open position, the locking pin having a plate adjacent its distal end and a spring bearing on said plate to spring load the locking pin to its locking position; and said paddle shaped levers arranged so that lateral movement of the levers in either direction withdraws the locking pin from the respective aperture to release, the side frames to allow the walker to fold by rotation of the side frames to close with the front frame.

11. The walker of claim 10 in which the front legs comprise hinge tubes, each formed of a tubular member, to which the locking mechanisms are respectively rotatably connected by respective rotation rings rotatably carried by the hinge tubes via respective bearing rings fixed thereto, a rigid support member bridging and interconnecting said hinge tubes.

12. The walker of claim 10 which the front leg adjacent each locking mechanism is formed with a pair of radially spaced apertures formed to receive the distal end of the locking pin, a first of said apertures being located at a first radial angle with respect to the front frame whereby to define said open position of the walker, the second of said apertures being located at a second radial angle with respect to the front frame greater than said first radial angle to define an extended open position of the walker.

13. The walker of claim 10 in which the front legs are each formed with a pair of radially spaced apertures formed to receive the distal end of the locking pin, a first of said apertures being located at a first radial angle with respect to the front frame whereby to define said open position of the walker, the second of said apertures being located at a second radial angle with respect to the front frame greater than said first radial angle to define an extended open position of the walker.

* * * * *